US005590798A

United States Patent [19]

O'Connell

[11] Patent Number: 5,590,798

[45] Date of Patent: Jan. 7, 1997

[54] CONTAINER-CLOSURE ASSEMBLY

[75] Inventor: Richard O'Connell, Perrineville, N.J.

[73] Assignee: Wheaton Holding, Inc., Wilmington, Del.

[21] Appl. No.: 512,291

[22] Filed: Aug. 8, 1995

[51] Int. Cl.[6] ..... B65D 1/02

[52] U.S. Cl. ..... 215/48; 215/228; 215/253; 220/278; 222/83; 222/107; 222/541.2

[58] Field of Search ..... 215/48, 228, 253, 215/387, DIG. 7; 220/212, 258, 278, 306; 222/83, 107, 541.2

[56] References Cited

U.S. PATENT DOCUMENTS 4,150,761 4/1979 Collins ..... 215/228
4,170,316 10/1979 LaBarbera ..... 220/306
4,230,230 10/1980 Mumford ..... 215/321
4,790,453 12/1988 Fontana ..... 222/83
5,271,513 12/1993 Crosnier et al. ..... 215/320

*Primary Examiner*—Stephen Cronin
*Attorney, Agent, or Firm*—Eugene E. Renz, Jr.

[57] ABSTRACT

A cap and tube assembly comprising: a tube for containing a product. A nozzle at one end of the tube has a thin wall portion defining a diaphragm puncturable to provide a discharge opening for dispensing of products. The cap is engagable over the nozzle and has puncturing means depending inwardly from the top of the cap operable upon actuation of the cap relative to the nozzle to puncture the diaphragm. Rib means on the interior of the cap snugly embraces the nozzle during axial movement of the cap to ensure alignment of the piercing element with a diaphragm during the piercing operation.

6 Claims, 2 Drawing Sheets

CONTAINER-CLOSURE ASSEMBLY

FIELD OF THE INVENTION

The present invention relates to container closure assemblies and more specifically to so called unit dose assemblies.

BACKGROUND OF THE INVENTION

Container closures of the type to which the present invention relates are not new per se. The patents listed below show generally unit dose packages of the type to which the present invention relates.

UNIT DOSE ASSEMBLY U.S. Pat. No. 5,052,589

UNIT DOSE ASSEMBLY U.S. Pat. No. 5,042,690

SUMMARY OF THE INVENTION

Even though these designs are generally suitable for the purposes intended, it has been found that on occasion, the caps tend to tilt or cock to the point where when the cap is pushed inwardly to penetrate the diaphragm, the piercing element aligns with a thick wall portion surrounding the diaphragm thus jamming the piercing operation.

With the foregoing in mind, it is an object of the present invention to provide an improved container-closure design including novel alignment means for ensuring accurate penetration of the diaphragm even when the pressure exerted by the user is not in a truly axial direction, thereby obviating and eliminating the problems of prior assemblies of this type discussed above.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
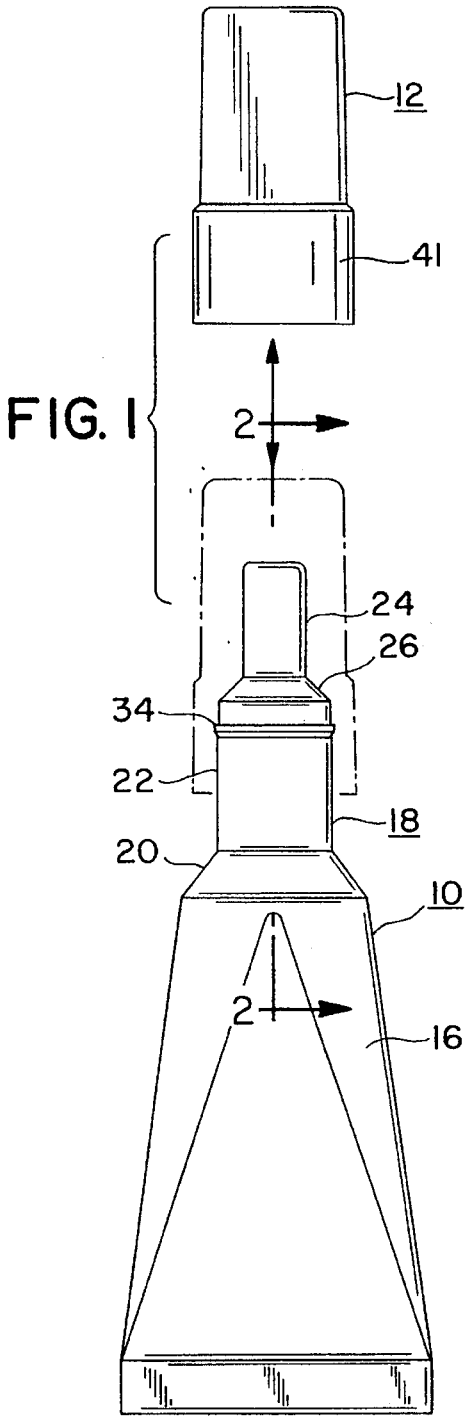
FIG. 1 is an exploded view of a container-closure assembly incorporating the present invention.
Figure 3:
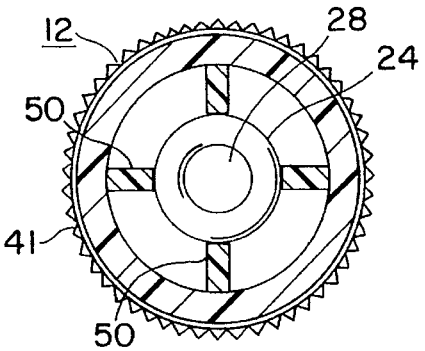
FIG. 3 is a sectional view taken on lines 3—3 of FIG. 2.
Figure 2:
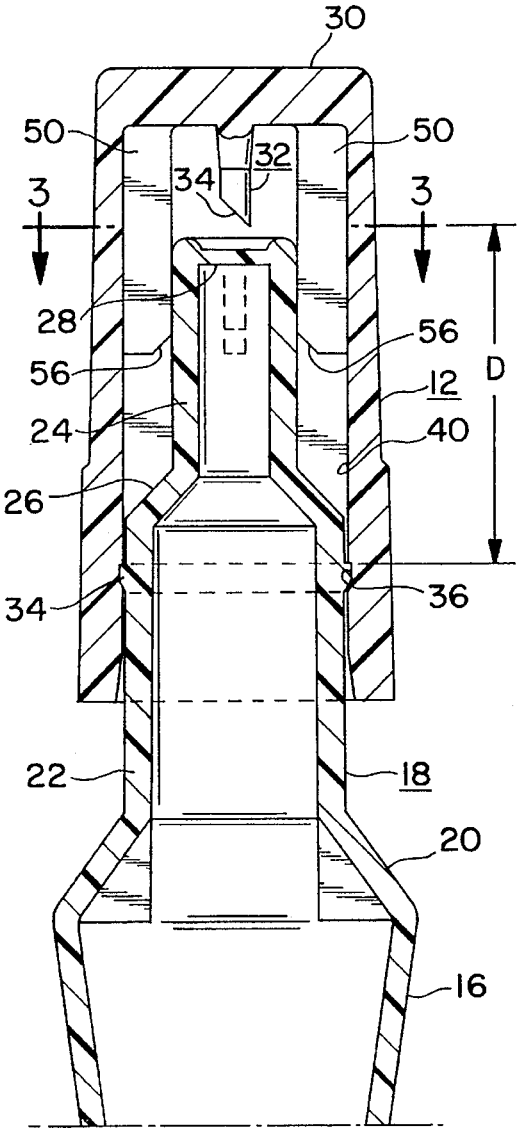
FIG. 2 is an enlarged transverse sectional view taken on lines 2—2 of FIG. 1.
Figure 4A:
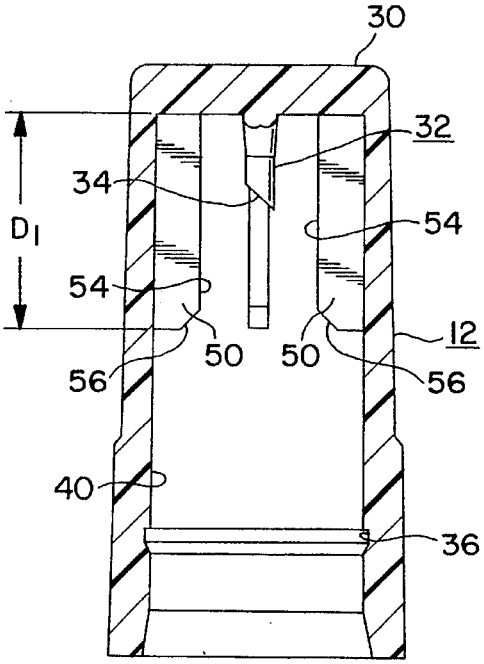
FIG. 4*a* is an enlarged transverse sectional view of the cap.
Figure 4B:
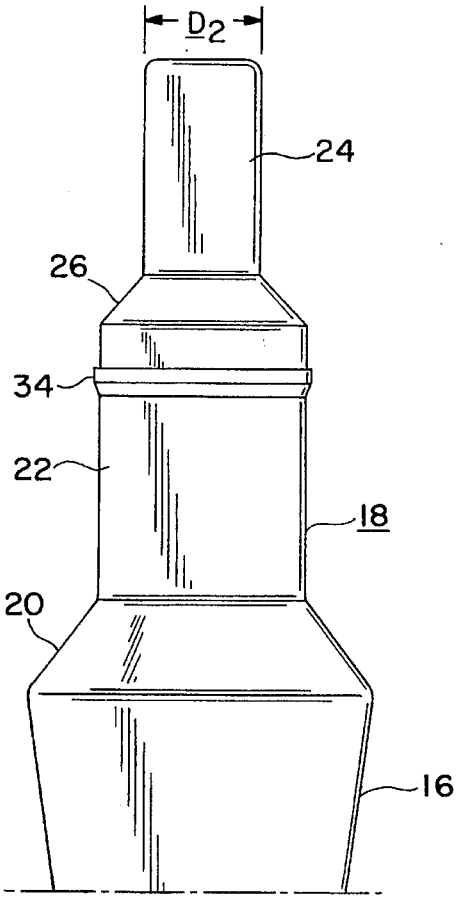
FIG. 4*b* is an enlarged fragmentary side elevational view of the nozzle end of the tube.
Figure 5:
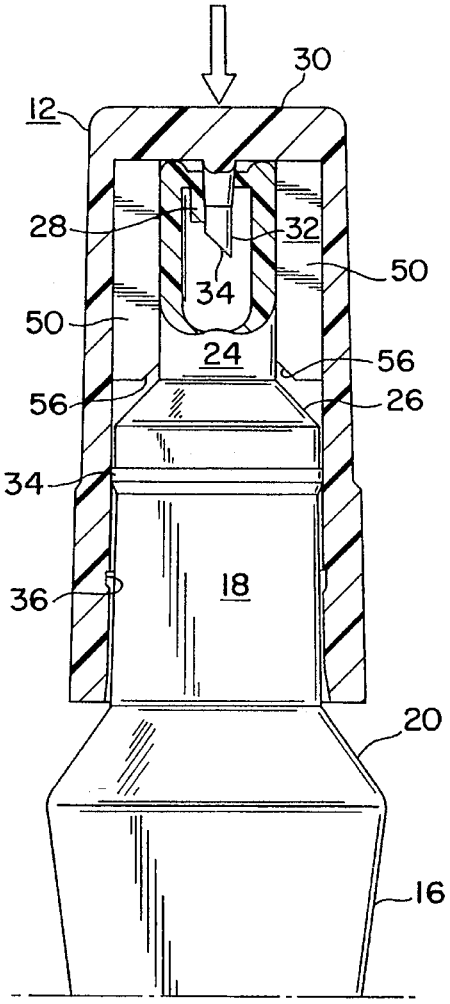
FIG. 5 is an enlarged fragmentary side elevational view partly in section showing the cap activated to a diaphragm piercing position.

Referring now the drawings and particularly to FIGS. 1–3 thereof, there is illustrated a unit dose container-closure assembly incorporating the present invention. The assembly essentially comprises a tube (10) and a cap (12) both made out of a plastic material such as polypropylene (polyethylene). The container (10) has a body portion (16) having a stepped neck or nozzle portion (18) connected to the body portion by a transition wall (20) of generally frusto conical configuration. The nozzle (18) includes a lower generally cylindrical portion (22) and a tip portion (24) of reduced cross-section connected by a frusto conical wall portion (26). The axial end face of the tip portion (24) is of reduced cross-section to define a diaphragm (28).

It is noted that the nozzle has been configured to reduce to a diameter approximately the same as a so called luer fitment so that the tube can fit on the end of a standard injection needle or can be inserted in various types of devices used in administering drugs intravenously.

The cap (12) as illustrated is of generally cylindrical shape having a top wall (30) and a centrally depending piercing element (32) having a biased piercing tip (34).

The cap and tube are provide with interengaging locking means, in the present instance, comprising a radially outwardly directed circumferentially extending rib (34) on the tube portion (18) and a circumferentially extending groove (36) on the interior sidewall (40) of the cap. The groove (36) is spaced downwardly a predetermined distance D from the piercing tip (34) of the piercing element (32) so that the tip is spaced above the diaphragm (26), when the rib (34) and groove (36) are interengaged in the manner shown in FIG. 2. This is the unarmed position of the assembly. The lower terminal edge of the sidewall (40) is beveled outwardly to engage more readily over the rib (34) when the cap is assembled to the tube. Further, the outer peripheral surface of the cap is knurled as at (41) adjacent the lower edge of the sidewall or skirt portion to facilitate gripping by the user for applying and removing the cap.

In accordance with the present invention, means is provided for guiding the piercing element so that upon activation of the cap, the piercing element (32) engages the diaphragm (26). To this end, guides in the form of ribs (50) are provided on the interior wall of the cap adjacent the top wall (30). In the present instance, there are four (4) circumferentially equi spaced ribs (50) which extend a distance $D_1$ from the top (30) beyond the piercing point (34) so that the upper tube portion (24) engages interiorly of the ribs (50) in the manner shown in FIG. 2. The circular trace defined by the inner edge (54) of the ribs (50) is preferably only slightly greater in diameter than the outer diameter $D_2$ of the tube portion (24) so that the cap is guided in a truly axial direction when pushed inwardly to activate the system. The ribs (50) have a beveled lower inner edge as at (56) to easily engage over the rounded edge tip portion (24).

Even though a particular embodiment of the invention has been illustrated and described herein, it is not intended to limit the invention and changes and modifications may be made therein within the scope of the following claims.

What is claimed is:

1. A cap and tube assembly comprising:

a tube for containing a product; a step nozzle at one end of the tube including a tip portion of reduced cross section connected to a lower portion by a wall portion;

means defining a thin wall portion forming a puncturable diaphragm in the axial end of the tip portion to provide a discharge opening for dispensing the product;

a cap engagable over the nozzle having puncturing means depending inwardly from top of the cap operable upon actuation of the cap relative to the nozzle to puncture the diaphragm; and a plurality of circumferentially spaced ribs extending axially from the top of the cap to a point below the tip of the piercing element snuggling engaging the tip portion in the unarmed position of the cap with the tip portion spaced above the diaphragm.

2. The cap and tube assembly as claimed in claim 1 including interengaging means on the cap and lower portion of the nozzle to normally position the cap and said unarmed position.

3. A cap and tube assembly as claimed in claim 1 wherein said interengaging means comprises a circumferentially extending radially outwardly directed rib on the lower portion of the nozzle and a circumferentially extending groove on the interior side wall of the cap spaced upwardly from the lower terminal edge thereof.

4. A cap and tube assembly as claimed in claim 1 wherein the lower terminal edge of the skirt of the cap is beveled.

5. A cap and tube assembly as claimed in claim 1 wherein the fib means comprises a plurality of ribs equi spaced circumferentially on the interior side wall of the cap.

6. A cap and tube assembly as claimed in claim 5 wherein the ribs are generally elongated and rectangular and the inner terminal edge of each of the ribs is beveled to function as a pilot portion when the cap is engaged initially over the nozzle and the inner edge of the ribs engages the tip of the nozzle adjacent the diaphragm.

* * * * *